US011293270B2

(12) United States Patent
Malone et al.

(10) Patent No.: US 11,293,270 B2
(45) Date of Patent: Apr. 5, 2022

(54) SLIDING SLEEVE SHUNT TUBE ISOLATION VALVE SYSTEM AND METHODOLOGY

(71) Applicant: Schlumberger Technology Corporation, Sugar Land, TX (US)

(72) Inventors: Scott Malone, Missouri City, TX (US); Kameron Klauber, Sugar Land, TX (US); Nitin Verroju, Houston, TX (US); Robert Krush, Sugar Land, TX (US); Michael Huh, Pearland, TX (US); Farhan Ahmed Omer, Rosharon, TX (US); Chidi Nwafor, Luanda (AO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 43 days.

(21) Appl. No.: 16/954,293

(22) PCT Filed: Dec. 17, 2018

(86) PCT No.: PCT/US2018/065921
§ 371 (c)(1),
(2) Date: Jun. 16, 2020

(87) PCT Pub. No.: WO2019/125987
PCT Pub. Date: Jun. 27, 2019

(65) Prior Publication Data

US 2021/0140280 A1 May 13, 2021

Related U.S. Application Data

(60) Provisional application No. 62/607,107, filed on Dec. 18, 2017.

(51) Int. Cl.

| | |
|---|---|
| ***E21B 43/04*** | (2006.01) |
| ***E21B 33/12*** | (2006.01) |
| ***E21B 34/12*** | (2006.01) |

(52) U.S. Cl.
CPC ..... *E21B 43/045* (2013.01); *E21B 33/12* (2013.01); *E21B 34/12* (2013.01); *E21B 2200/06* (2020.05)

(58) Field of Classification Search
CPC ..... E21B 43/045; E21B 33/12; E21B 34/12; E21B 2200/06; E21B 43/04
See application file for complete search history.

(56) References Cited

U.S. PATENT DOCUMENTS 6,298,916 B1 10/2001 Tibbles et al.
6,588,506 B2 7/2003 Jones
(Continued)

FOREIGN PATENT DOCUMENTS

WO 2017155546 A1 9/2017

OTHER PUBLICATIONS

International Preliminary Report on Patentability issued in the PCT Application PCT/US2018/065921, dated Jul. 2, 2020 (8 pages).
(Continued)

*Primary Examiner* — Steven A MacDonald
(74) *Attorney, Agent, or Firm* — Matthew Goode

(57) ABSTRACT

A technique facilitates performance of a gravel packing operation and desired zonal isolation. An apparatus, e.g. a sliding sleeve shunt tube isolation valve, may be deployed downhole and configured to facilitate a gravel packing operation and zonal isolation. By way of example, the apparatus contains a conduit which in an open position allows the flow of gravel pack slurry and in a closed position creates a barrier. In the closed position, upper and lower portions of the conduit are isolated from one another. When the apparatus is coupled with a packer and sand screens, the apparatus serves to create complete zonal isolation in, for example, an open hole alternate path system.

11 Claims, 11 Drawing Sheets

(56) References Cited

U.S. PATENT DOCUMENTS

| | | | | |
|---|---|---|---|---|
| 7,562,709 | B2 | 7/2009 | Saebi et al. | |
| 8,453,734 | B2 | 6/2013 | Jasek et al. | |
| 8,701,765 | B2 | 4/2014 | Jasek et al. | |
| 9,010,417 | B2 | 4/2015 | Garcia et al. | |
| 9,637,999 | B2 | 5/2017 | Garcia et al. | |
| 10,060,198 | B2 | 8/2018 | Garcia et al. | |
| 2004/0094302 | A1 | 5/2004 | Booth | |
| 2008/0128129 | A1 | 6/2008 | Yeh et al. | |
| 2013/0000899 | A1* | 1/2013 | Broussard | E21B 43/08 166/278 |
| 2013/0312960 | A1 | 11/2013 | Jasek et al. | |
| 2015/0041130 | A1* | 2/2015 | Cleveland | E21B 23/06 166/276 |
| 2016/0186502 | A1* | 6/2016 | Nguyen | E21B 19/16 166/380 |
| 2018/0094508 | A1* | 4/2018 | Smith | E21B 43/26 |
| 2020/0080404 | A1* | 3/2020 | Frosell | E21B 43/04 |
| 2021/0140280 | A1* | 5/2021 | Malone | E21B 43/045 |

OTHER PUBLICATIONS

Office Action issued in AZ application a20200056, dated Apr. 7, 2021 (5 pages).

International Search Report and Written Opinion issued in the PCT Application PCT/US2018/065921, dated Apr. 1, 2019 (14 pages).

* cited by examiner

SLIDING SLEEVE SHUNT TUBE ISOLATION VALVE SYSTEM AND METHODOLOGY

CROSS-REFERENCE TO RELATED APPLICATION

The present document is based on and claims priority to U.S. Provisional Application Ser. No. 62/607,107, filed Dec. 18, 2017, which is incorporated herein by reference in its entirety.

BACKGROUND

In many hydrocarbon well applications, a wellbore is drilled and completion equipment is deployed downhole into the wellbore. A gravel packing operation may be performed to provide a gravel pack in the annulus around the completion equipment to limit the inflow of unwanted particulates. Various alternate path systems have been used to help ensure flow of gravel slurry throughout the gravel pack region so that a uniform gravel pack is placed along the desired portion of the annulus. In some applications, however, difficulties can arise in creating zonal isolation between well zones after flowing the gravel slurry.

SUMMARY

In general, a system and methodology are provided which facilitate performance of a gravel packing operation and desired zonal isolation. An apparatus, e.g. a sliding sleeve shunt tube isolation valve, is configured to facilitate a gravel packing operation and zonal isolation when deployed downhole. By way of example, the apparatus contains a conduit which in an open position allows the flow of gravel pack slurry and in a closed position creates a barrier and zonal isolation between upper and lower transport zones. In the closed position, upper and lower portions of the conduit are isolated from one another. The apparatus may be coupled with a packer and sand screens to enable complete zonal isolation in, for example, an open hole alternate path system.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
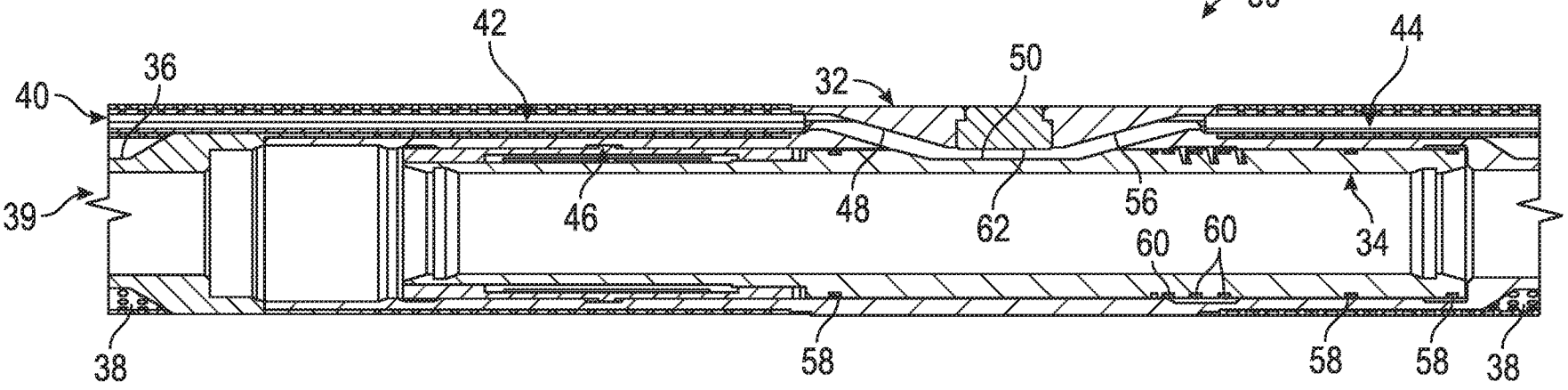
FIG. 1 a cross-sectional view of an example of a well completion system having an embodiment of a sliding sleeve shunt tube isolation valve in an open flow position, according to an embodiment of the disclosure.
Figure 2:
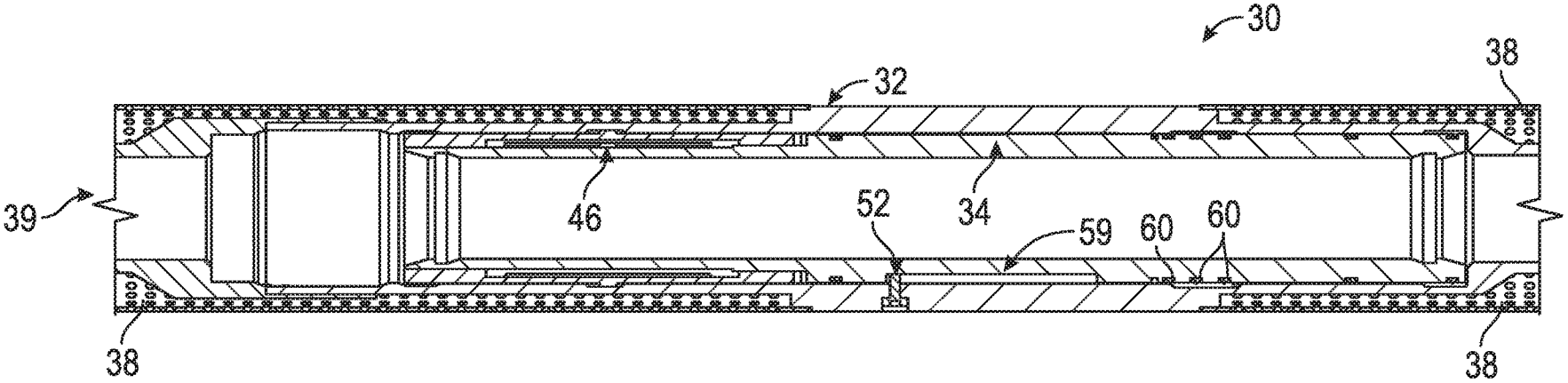
FIG. 2 is cross-sectional view of the well completion system illustrated in FIG. 1 but at a different orientation, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate performance of a gravel packing operation and desired zonal isolation along a wellbore. An apparatus may be deployed downhole and is configured to facilitate a gravel packing operation and zonal isolation. The apparatus may be in the form of a sliding sleeve shunt tube isolation valve having an inner sleeve slidably positioned in an outer housing. The apparatus may contain a conduit which allows the flow of gravel pack slurry when the inner sleeve is moved to an open position. However, a barrier is created when the inner sleeve is moved to a closed position so as to create a desired isolation between well zones. In the closed position, upper and lower portions of the conduit are isolated from one another. When the apparatus is coupled with a packer and sand screens, the apparatus serves to create complete zonal isolation in, for example, an open hole alternate path system.

According to an embodiment, the apparatus comprises the outer housing which is constructed to channel slurry radially inward while also providing an exit path in the outward radial direction. The inner sleeve is shiftable between positions and may contain an external groove (or pocket) to allow a flow path for slurry. Discrete sealing elements, e.g. at least three discrete sealing elements, may be located on the inner shifting sleeve. The sealing elements function in the open position to isolate the gravel pack transport zone from apparatus tubing. In this position, there are two independent pressure zones. In the closed position, the sealing elements serve to isolate an upper transport zone from a lower transport zone and from the apparatus tubing. In this position there are three independent pressure zones.

While pumping a gravel pack job, a slurry (a mixture of proppant suspended in fluid) is pumped to fill an annular space between a formation and a series of screens. In an alternate path system, shunt tubes are utilized to transport and disperse the gravel pack to multiple spaces throughout the well in the event that bridging occurs. The apparatus, e.g. sliding sleeve shunt tube isolation valve, allows the slurry to move to zones below when in an open position so as to complete the gravel pack. Following the gravel pack, the apparatus is closed to isolate the system of tubes, e.g. shunt tubes, between the various zones.

The apparatus may accomplish the desired tasks by controlling the direction of the flow through the conduits which is initially in a radially inward direction toward the center and then in a radially outward direction toward the annulus. This change in direction of flow in the conduits, e.g. shunt tubes, allows for an inner axial sliding sleeve to allow or prevent flow through the conduits.

Referring generally to FIGS. 1-4, an example of such an apparatus 30 is illustrated in the form of a sliding sleeve shunt tube isolation valve. In this example, the apparatus 30 comprises an outer housing 32 and an inner sleeve 34, e.g. an inner shifting sleeve, axially slidable within the outer housing 32. The outer housing 32 may be coupled with apparatus tubing 36, portions of which may be surrounded by screen sections 38. The apparatus 30 and apparatus tubing 36 have a generally centralized flow passage 39 through which fluid may be directed. A tube 40, e.g. a plurality of tubes 40, may be positioned along the apparatus tubing 36, e.g. along its exterior, and coupled with outer housing 32. By way of example, the tubes 40 may be in the form of shunt tubes for carrying gravel slurry. In the example illustrated, each conduit 40 comprises an upper transport conduit 42 and a lower transport conduit 44 which create upper and lower transport zones, respectively. Additionally, the inner sleeve 34 may be releasably coupled with the outer housing 32 via a mechanism such as a collet 46.

In an open position, the gravel pack slurry flows initially through upper transport tubes 42, e.g. two separate rectangular tubes, and into corresponding entry ports 48 through the inner diameter of the outer housing 32. The slurry flow continues into a single pocket or axial groove 50 in the inner sleeve 34 which is formed along a portion, e.g. a quarter, of the outer diameter of the inner sleeve 34 (see FIG. 1). An alignment key 52, e.g. alignment pin, may extend from the outer housing 32 and into an axial slot 54 in the inner sleeve 34 ensuring that the pocket 50 in the inner sleeve 34 remains oriented under the ports 48 (see FIG. 2).

The gravel pack slurry passes through the pocket 50 in the inner sleeve 34 and into exit ports 56 in the outer housing 32 and splits back into lower transport tubes 44, e.g. two separate rectangular tubes. A plurality of seals 58 may be positioned about inner sleeve 34 at a location uphole of entry ports 48 and downhole of exit ports 56 to isolate the conduit 40, or transport zone, from the tubing 36 and center of apparatus 30.

Figure 3:
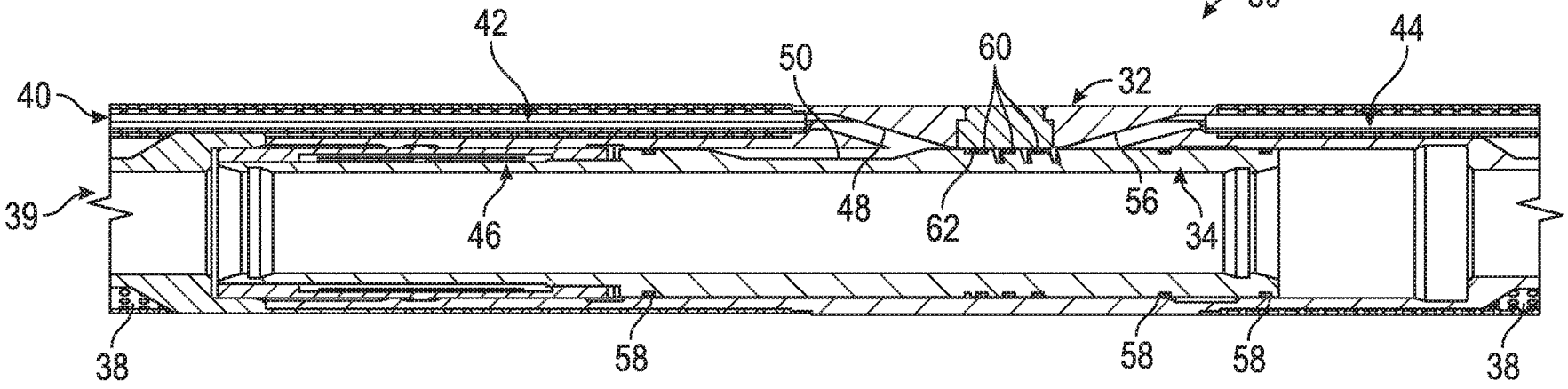
FIG. 3 a cross-sectional view similar to that of FIG. 1 but with the sliding sleeve shunt tube isolation valve in a closed flow position, according to an embodiment of the disclosure.
Figure 4:
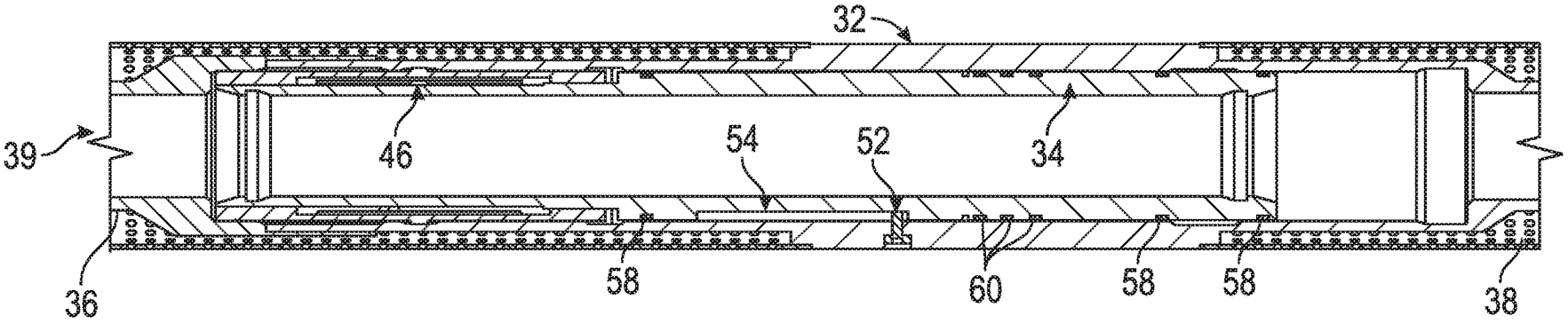
FIG. 4 a cross-sectional view similar to that of FIG. 2 but with the sliding sleeve shunt tube isolation valve in a closed flow position, according to an embodiment of the disclosure.

When the inner sleeve 34 is shifted axially to the closed position illustrated in FIGS. 3 and 4, a plurality of inner seals 60 positioned about inner sleeve 34 land on a seal bore 62 of outer housing 32 between entry ports 48 and exit ports 56. The seals 60 serve as a barrier between the zones of upper transport conduits 42 and lower transport conduits 44 when the apparatus 30 is in the closed position. The seals 58 continue to isolate the conduits 40 from the apparatus tubing 36 and center of apparatus 30.

In this embodiment, collet 46 is attached to the inner sleeve 34 and is used to determine the force for shifting the inner sleeve 34 between the open and closed positions. The force is determined according to the forces which are able to compress the collet 46 to enable axial movement from the open or closed positions. A feature of apparatus 30 is that it may be a pressure balanced to a barrier controllable by a mechanical mechanism. A differential pressure forming across the apparatus 30, e.g. across the sliding sleeve shunt tube isolation valve, does not result in a change in position.

Figure 5:
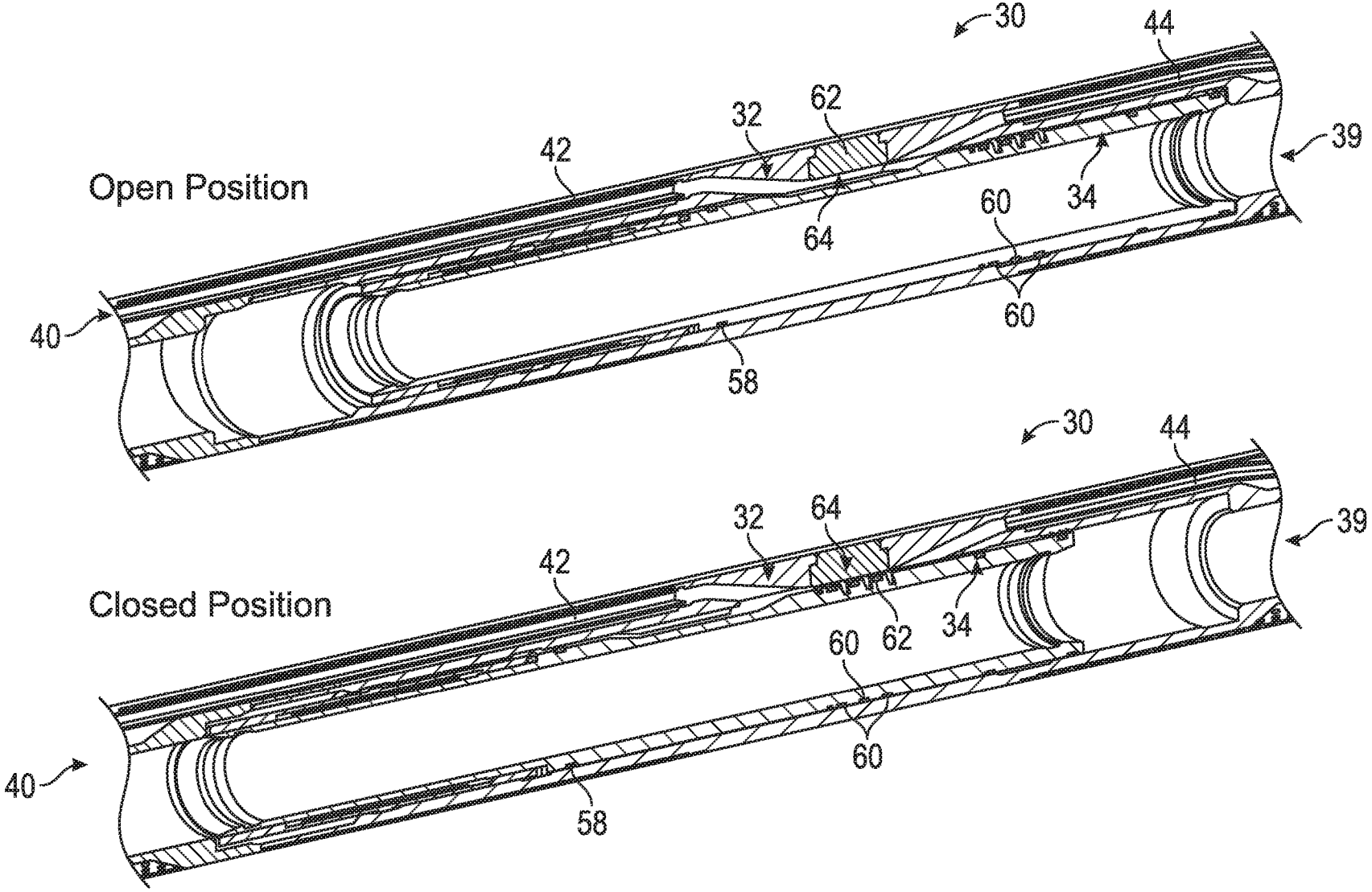
FIG. 5 is an illustration of an example of the sliding sleeve shunt tube isolation valve showing various features, according to an embodiment of the disclosure.

According to embodiments described herein, the sliding sleeve shunt tube isolation valve/apparatus 30 may comprise various unique features. Referring generally to FIG. 5, for example, the seal bore 62 may be hardened or otherwise treated to prevent erosion. For example, a tungsten carbide coating 64 may be applied to the region of seal bore 62. The seal surface along seal bore 62 is responsible for creating the barrier between the upper conduits 42 and the lower conduits 44 in the closed position and is fully exposed to the abrasive slurry during the gravel pack when apparatus 30 is in an open position. Abrasive slurry at appreciable flow rates tends to cause erosion to surfaces contacted by the slurry. Erosion of the surface can compromise the ability of the apparatus/valve 30 to hold pressure when in the closed position.

To overcome this challenge, the tungsten carbide coating 24 may be applied via, for example, laser welding along seal bore 62 at the sealing location. Tungsten carbide in the as applied state may be rough in nature. However, the tungsten carbide layer 64 at the sealing location may be ground smooth to a desirable surface finish, e.g. a 32 RA surface finish, to provide a suitable seal surface.

Additionally, seals such as seals 58 and seals 60 may be placed in external grooves formed along the exterior of inner sleeve 34. While the sliding sleeve shunt tube isolation valve 30 is in the open position, the seals 58, 60 are shielded from the abrasive slurry by their position within the bore of outer housing 32.

Figure 6:
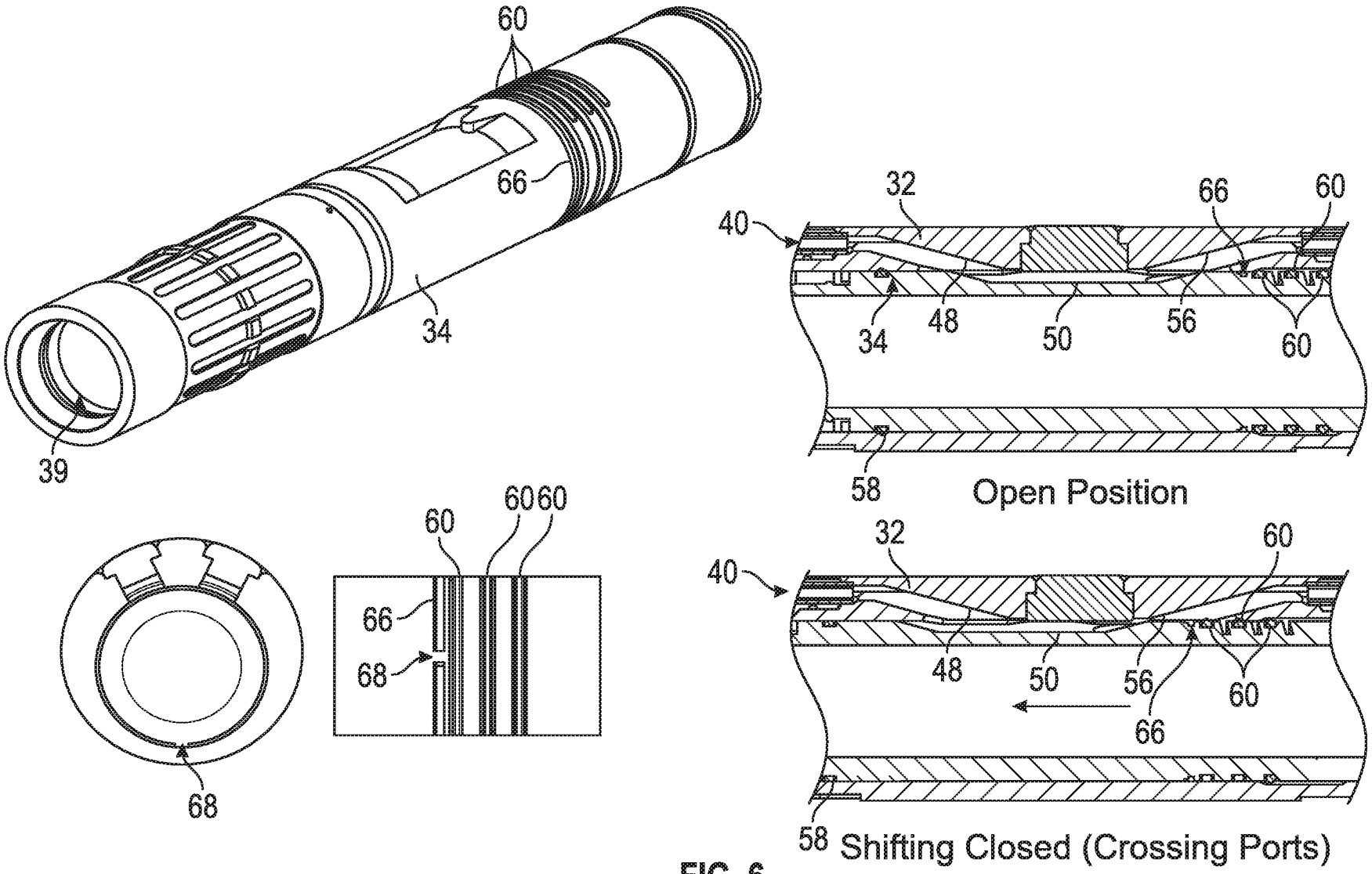
FIG. 6 is an illustration of an example of the sliding sleeve shunt tube isolation valve showing various features, according to an embodiment of the disclosure.

Referring generally to FIG. 6, some embodiments of the sliding sleeve shunt tube isolation valve 30 may include a scraper ring 66 to assist with the removal of debris between the seals 60 and the corresponding sealing surface. To facilitate operation in a proppant ridden environment, the scraper ring 66 may be added to a front side of the seals 60 to scrape the bore of outer housing 32 as the inner sleeve 34 is shifted. In the example illustrated, the scraper ring 66 travels across two discrete flow ports 48, 56 and may be a split ring. For example, the scraper ring 66 may form a partial circle, e.g. 350°, and sit in a corresponding external groove along the exterior of inner sleeve 34. A restriction member 68, e.g. an incomplete portion of the external groove or an abutment in the external groove, may be located between the ends of the scraper ring 66. By way of example, the external groove may be formed to extend 351° about the inner sleeve 34.

Because the inner sleeve 34 is rotationally locked by alignment key 52 and corresponding groove 54, the restriction member 68 is able to ensure the ends of scraper ring 66 remain oriented away from the entry and exit ports 48, 56 of outer housing 32. In this manner, the scraper ring does not become unseated from its groove when crossing the ports 48, 56. Maintaining this orientation eliminates the potential for the scraper ring 66 to become caught in the ports 48, 56 which could tend to prevent full travel of the inner sleeve 34.

Figure 7:
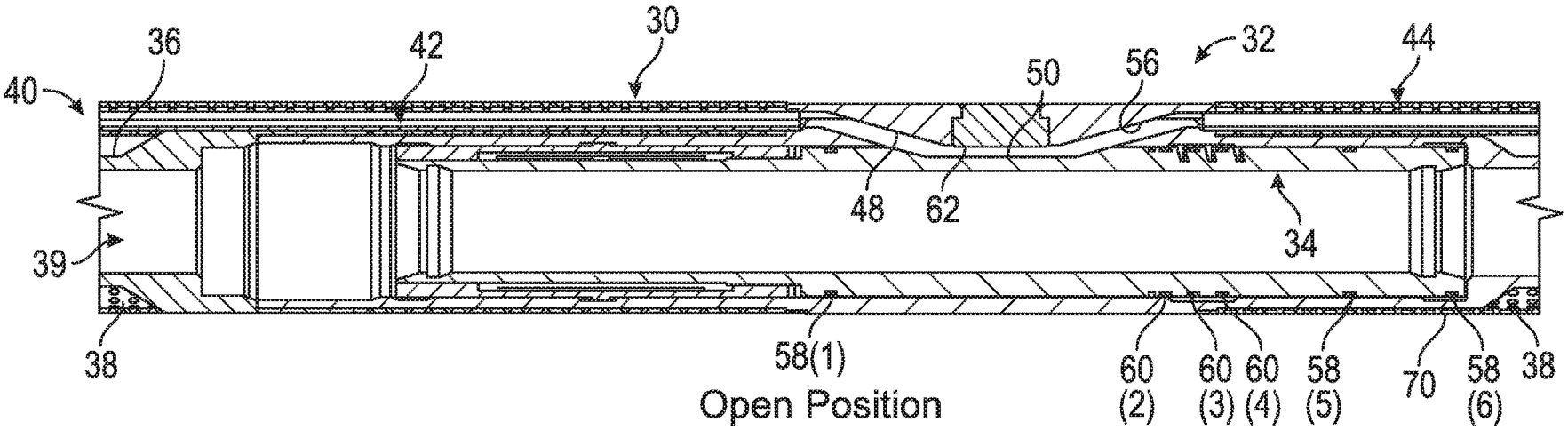
FIG. 7 is an illustration of an example of the sliding sleeve shunt tube isolation valve in an open flow position and showing various features, according to an embodiment of the disclosure.
Figure 8:
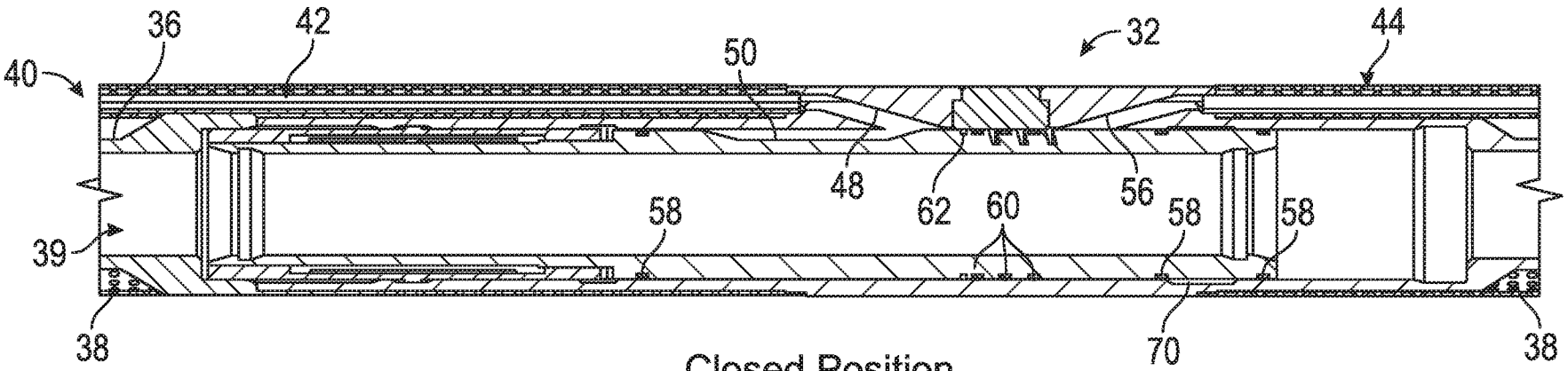
FIG. 8 is an illustration of an example of the sliding sleeve shunt tube isolation valve in a closed flow position and showing various features, according to an embodiment of the disclosure.

Referring generally to FIGS. 7 and 8, some embodiments of the sliding sleeve shunt tube isolation valve 30 may be configured to facilitate pressure balancing of redundant seals while preventing exposure to proppant/debris. In the example illustrated, seals 58, 60 comprise six seals which are positioned on shifting inner sleeve 34. To facilitate explanation, the seals 58, 60 have been individually labeled 1 through 6 in FIG. 7. In the valve open position illustrated in FIG. 7, seals 1 and 5 provide isolation between the apparatus tubing 36 and the transport zones provided by upper transport tubes 42 and lower transport tubes 44. In the valve closed position illustrated in FIG. 8, seals 1 and 6 provide isolation between the apparatus tubing 36 and the transport zones. Additionally, in the closed position, seals 2, 3, 4 (seals 60) provide isolation between the upper and lower transport zones provided by upper transport tubes 42 and lower transport tubes 44, respectively.

Generally speaking, when multiple seals in independent grooves are used in this type of configuration it can be helpful to ensure that atmospheric pressure is not trapped between the seals. Trapped pressure between the seals can inhibit the ability of the valve to shift and seal. Pressure balancing of seal number 6 may be accomplished by, for example, providing an undercut 70 in the outer housing 32.

Figure 9:
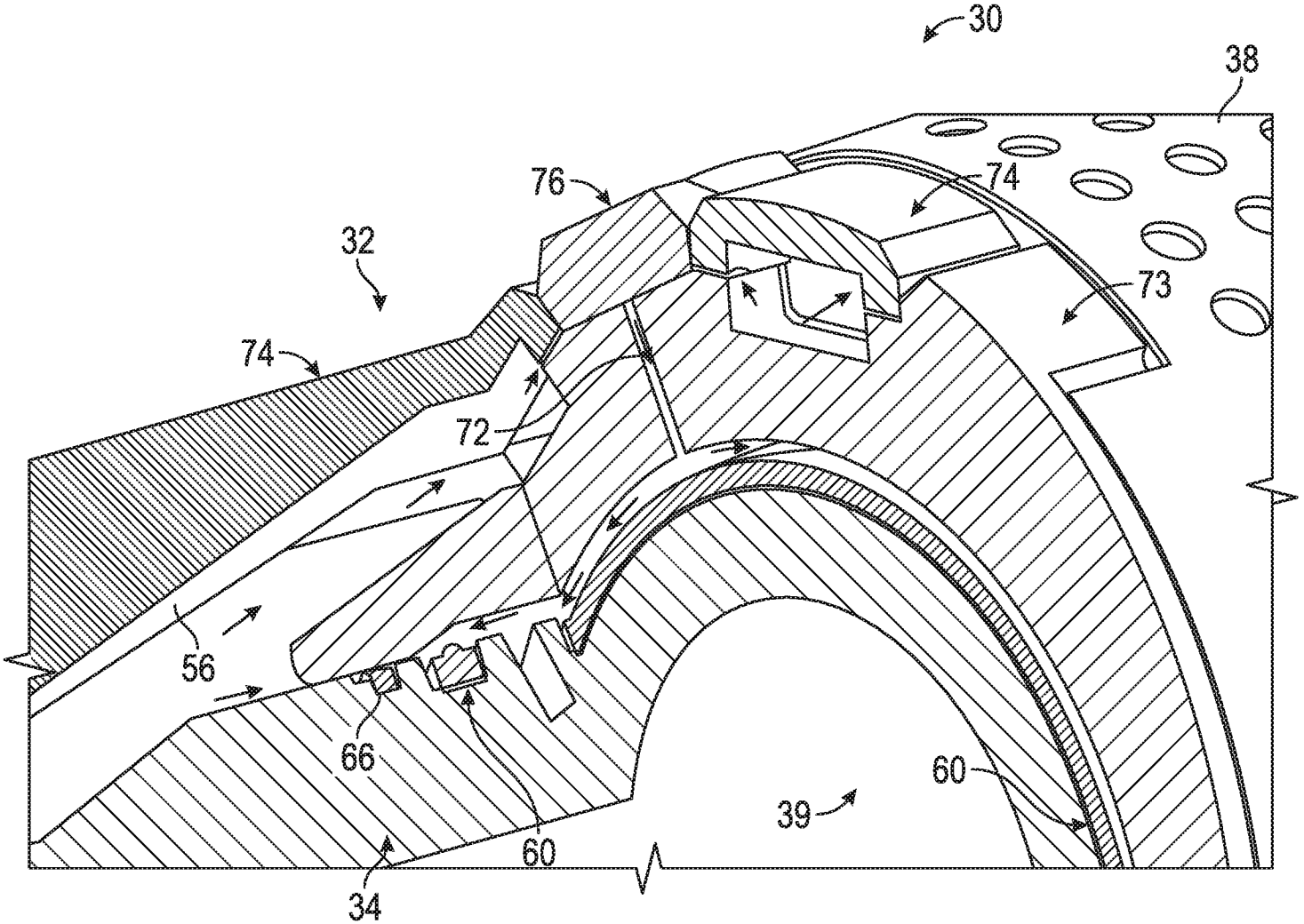
FIG. 9 is an illustration of an example of the sliding sleeve shunt tube isolation valve showing various features, according to an embodiment of the disclosure.

In this embodiment, the seals 2, 3, 4 (seals 60) are pressure balanced while not being exposed to slurry. This may be accomplished by providing a small gap in the outer housing 32 between the exit ports 56, e.g. two exiting ports. The small gap may be positioned to intersect a small hole 72 drilled radially inward into an undercut in the inner diameter of the outer housing 32, as illustrated in FIG. 9.

In this example, the outer housing 32 has a main body 73 with a plurality, e.g. four, welded flow diverters 74. For example, two flow diverters 74 may be located at entry ports 48 and two flow diverters 74 may be located at exit ports 56. A small cap 76 may be welded between the two exit ports flow diverters 74. The weld joints on the outside of the parts allow pressure integrity between the annulus outside of the apparatus and the transport zone. The flow diverters 74 and cap 76 may be provided with features designed to allow pressure communication when welded onto the main body 73 of the outer housing 32. The small size of the flow paths allows hydraulic communication but prevents the migration of proppant. Based on the position of seals 60 within the undercut and the apparatus architecture, this geometry prevents the forming of atmospheric chambers.

Figure 10:
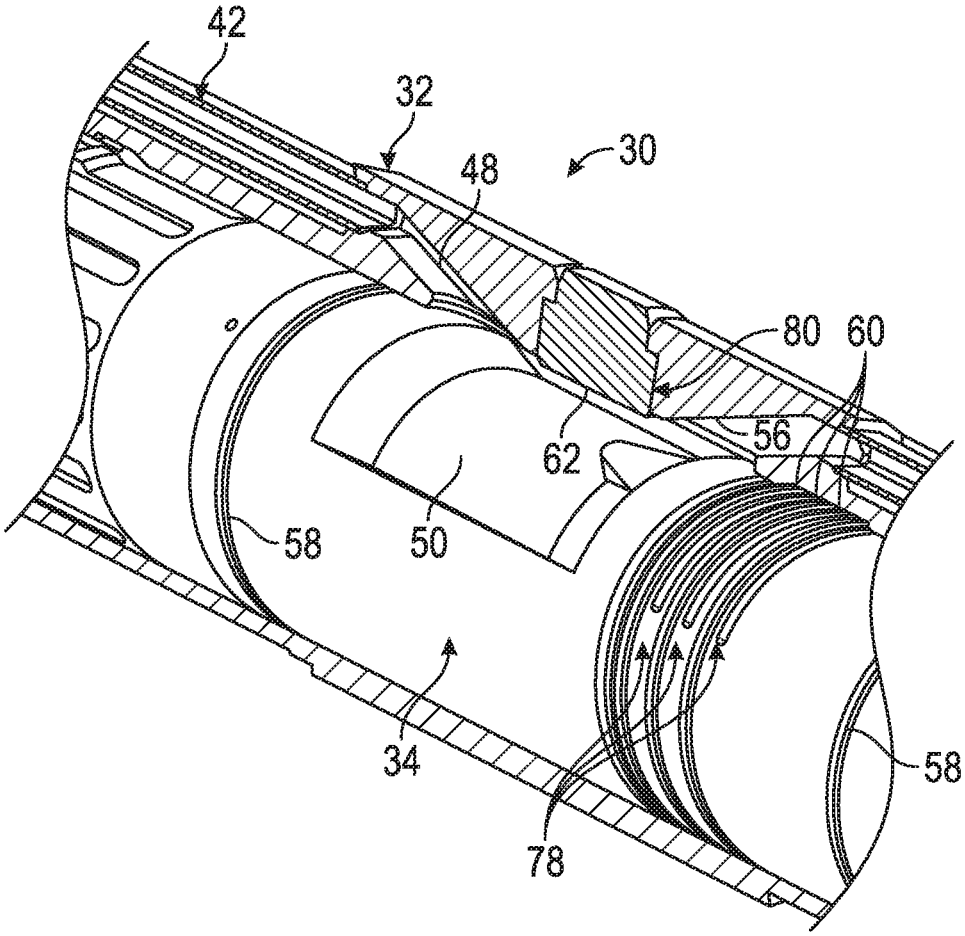
FIG. 10 is an illustration of an example of the sliding sleeve shunt tube isolation valve showing various features, according to an embodiment of the disclosure.
Figure 11:
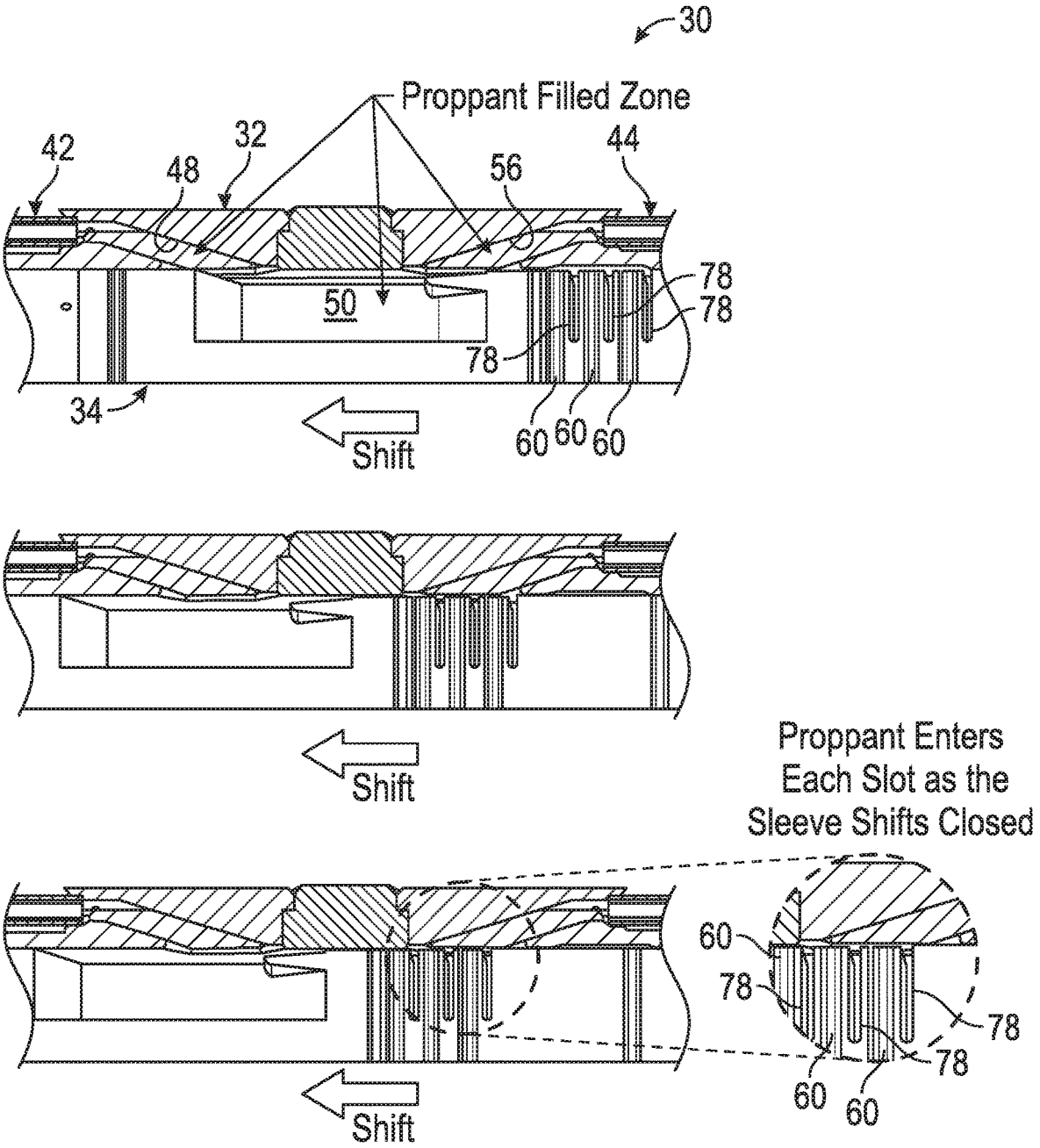
FIG. 11 is an illustration of an example of the sliding sleeve shunt tube isolation valve showing various features, according to an embodiment of the disclosure.

As described above, the seals 2, 3, 4 are protected from proppant during circulation of the proppant. However, as the sliding sleeve shunt tube isolation valve is shifted from the open position to the closed position, the seals are momentarily exposed to proppant. If an excessive amount of proppant stays on top of seals 2, 3, 4, it could prevent the valve from shifting to the fully closed position and/or compromise the ability of the seals to hold pressure. To overcome this challenge, embodiments of apparatus/valve 30 employ slots 78 incorporated behind the seals 2, 3, 4 (seals 60) as illustrated in FIGS. 10 and 11.

The slots 78 are angled such that they are aligned directly under the ports 48, 56 and do not cover the entire outer diameter. When the seals 2, 3, 4 enter the region of seal bore 62, the proppant contacts an exit port edge 80 and is displaced into the slots 78. As the apparatus is shifted from the open position to the closed position, the slots slightly increase the transport zone volume allowing a true displacement of slurry.

Figure 12:
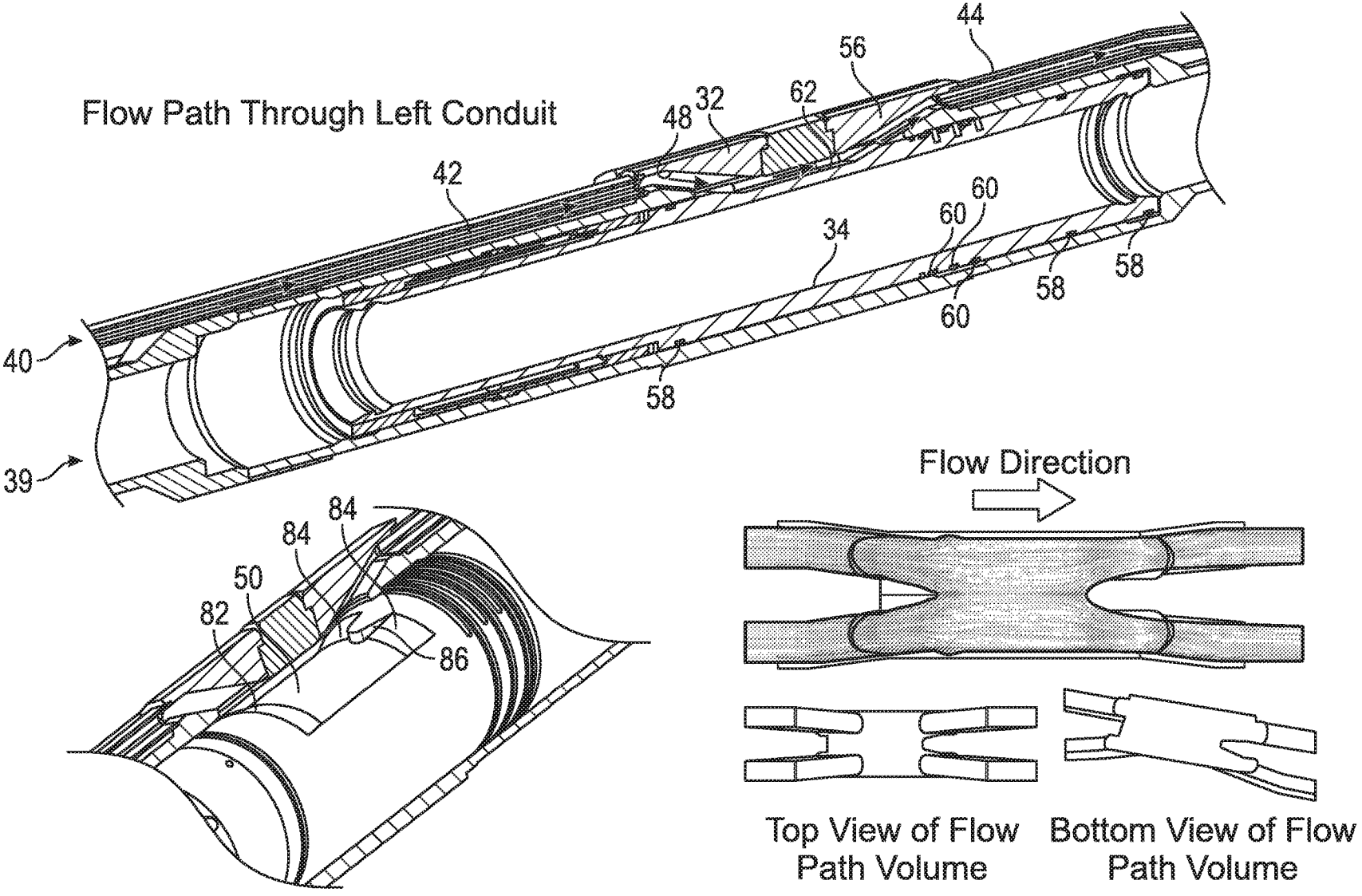
FIG. 12 is an illustration of an example of the sliding sleeve shunt tube isolation valve showing various features, according to an embodiment of the disclosure.

Referring generally to FIG. 12, embodiments of the sliding sleeve shunt tube isolation valve 30 may be constructed with an optimized flow path. For example, the design of the slurry flow path may be optimized to allow the slurry to enter the pocket 50, e.g. the combined zone between inner sleeve 34 and housing 32, via a downward (inward radially) sloped ramp(s) 82 as it moves through and out of entry ports 48. The flowing slurry then flows through the pocket 50 and is forced to diverge upwardly (outward radially) via an upward sloped ramp(s) 84 into lower transport tubes 44 as it moves into and through exit ports 56.

The flow path structure creates a dynamic fluid path which minimizes the pressure drop and erosion. Additionally, the flow path prevents proppant from gathering and settling in places which could increase sliding friction or prevent shifting altogether. Due to the abrasive nature of proppant in slurry, the portion of outer housing 32 and inner sleeve 34 exposed to the flow path are at higher risk of erosion. Various features can be designed in the flow path to reduce the risk by streamlining the flow and avoiding abrupt change in fluid velocity.

For example, the flow diverters 74 of outer housing 32 may be constructed to guide the fluid at an angle when entering the combined zone/pocket 50 and while exiting into the lower conduits 44 so as to avoid abrupt changes in flow direction. The diverters 74 also may be designed to maintain the fluid volume constant, thus maintaining a constant flow velocity entering and exiting the combined zone. The pocket 50 may include a U-shaped feature 86 formed into the exterior of inner sleeve 34 to further streamline the flow as it diverges upward from the inner sleeve 34 to the lower transport conduits 44 along the outer housing 32. This feature helps to minimize recirculation of fluid at the interface of the inner sleeve 34 and outer housing 32, thus reducing the risk of fluid eroding into the seals.

Figure 13:
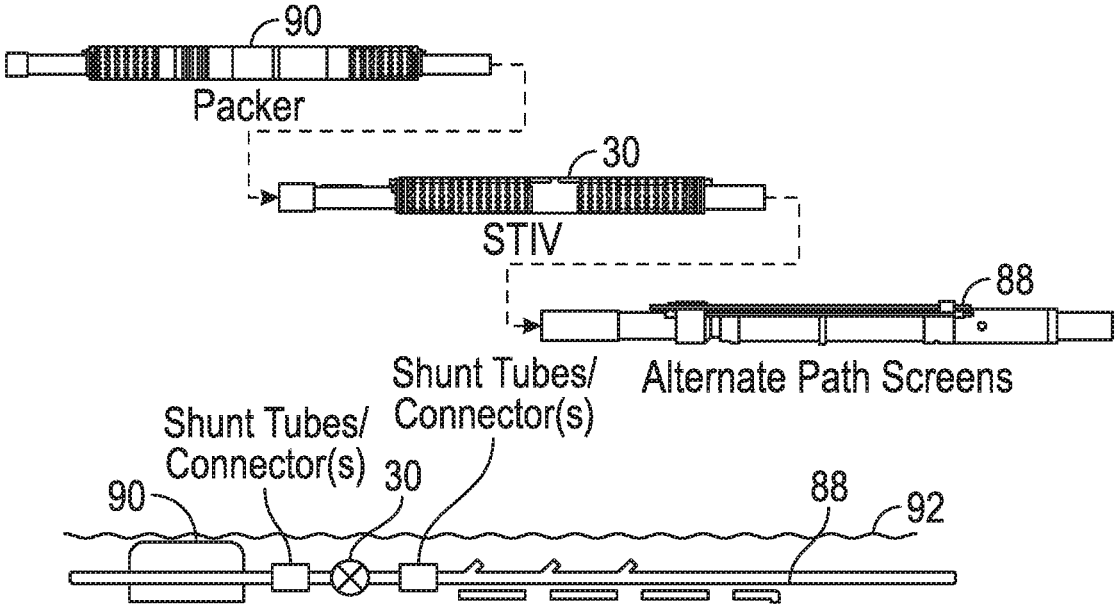
FIG. 13 is an illustration of an example of a sliding sleeve shunt tube isolation valve module combined with a packer module and an alternate path screen system for deployment in an open hole wellbore, according to an embodiment of the disclosure.
Figure 14:
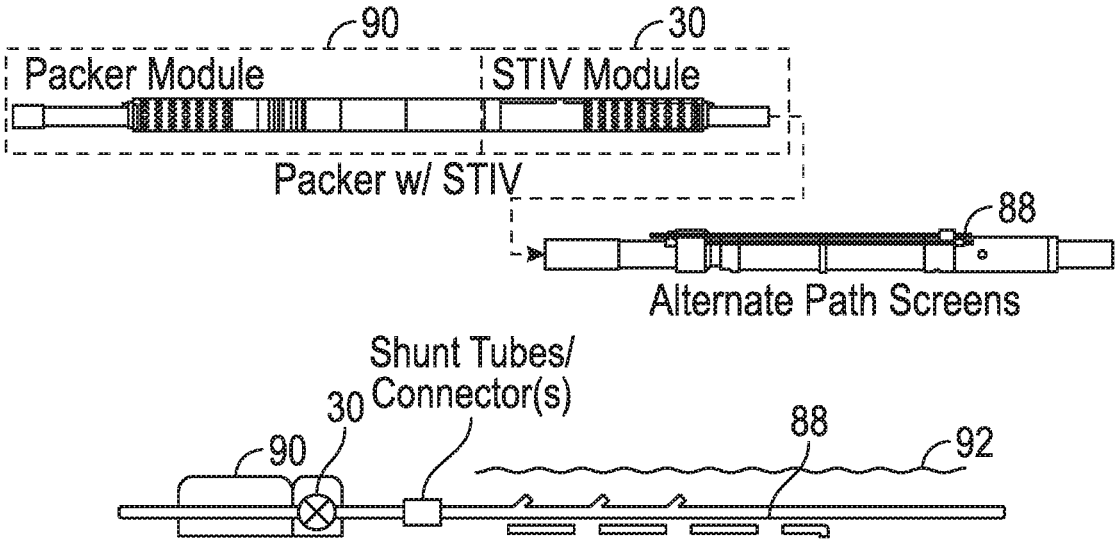
FIG. 14 is an illustration of another example of a sliding sleeve shunt tube isolation valve module combined with a packer module and an alternate path screen system for deployment in an open hole wellbore, according to an embodiment of the disclosure.

The sliding sleeve shunt tube isolation valve 30 may be used in a variety of downhole applications. For example, the apparatus/valve 30 may be combined with a variety of alternate path screen systems 88 and a variety of packer modules 90, as illustrated in FIGS. 13 and 14. In the embodiment illustrated in FIG. 13, the shunt tube isolation valve 30 and the packer modules 90 are constructed as independent products coupled together with conduits which serve to both bridge the space between them and allow transport of slurry.

In other embodiments, such as the embodiment illustrated in FIG. 14, the packer modules 90 and the shunt tube isolation valve 30 may be combined in a modular platform and utilized with a variety of alternate path screen systems 88 in various types of wellbores 92, e.g. open hole wellbores. By way of example, both the packer module 90 and the shunt tube isolation valve 30 may be mechanically actuated with, for example, a shifting device.

Figure 15:
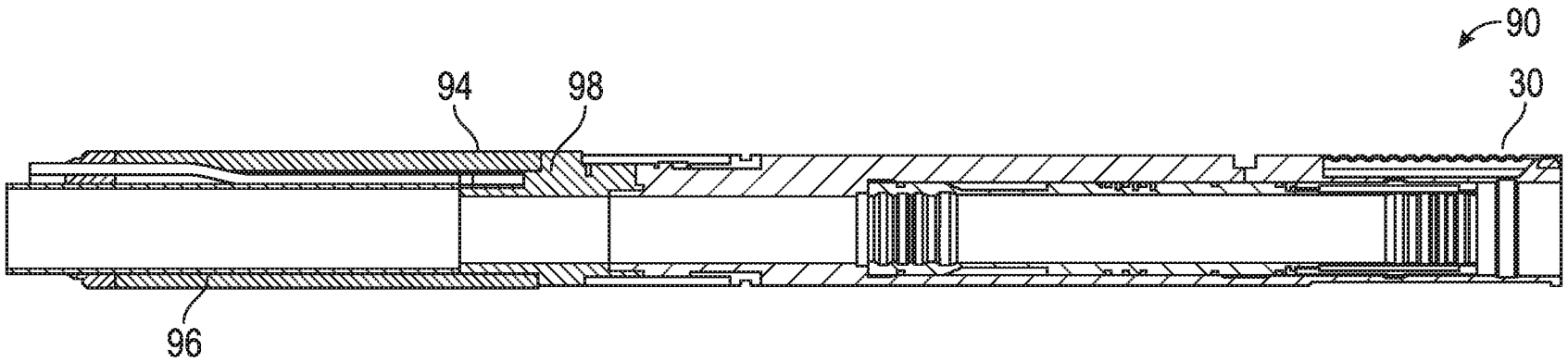
FIG. 15 is an illustration of an example of a sliding sleeve shunt tube isolation valve module combined with a swellable packer, according to an embodiment of the disclosure.
Figure 16:
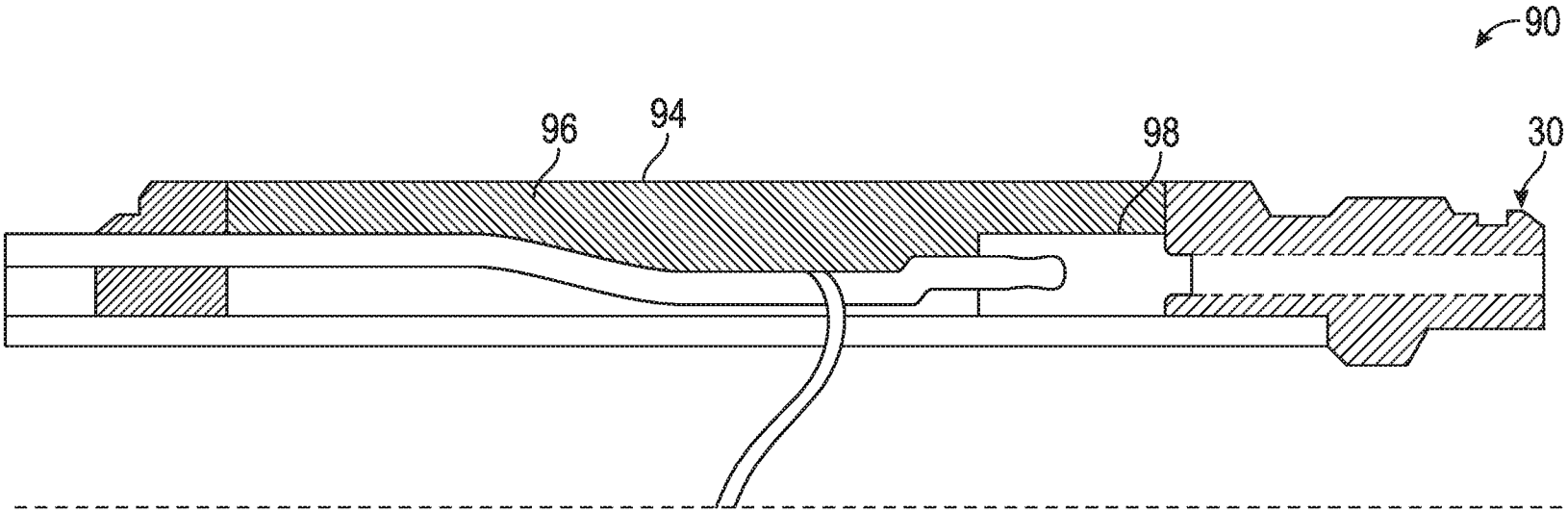
FIG. 16 is an illustration of an example of a sliding sleeve shunt tube isolation valve module combined with a swellable packer, according to an embodiment of the disclosure.

In some embodiments, the sliding sleeve shunt tube isolation valve 30 may be combined with packer module 90 having a swellable packer 94, as illustrated in FIGS. 15 and 16. The swellable packer 94 may be constructed with alternate path conduits running through the uphole end, through the center of a swellable element 96, and terminating in a manifold 98. The manifold 98 may be used to split the flow from, for example, rectangular tubes and into cylindrical holes and then directly into the shunt tube isolation valve 30.

In this type of embodiment, the swellable packer 94 may be set by swelling over time while the shunt tube isolation valve 30 is mechanically actuated with a shifting tool. In various implementations, the swellable packer 94 may initially be set, the gravel pack job may then be completed via the shunt conduits, and then the valve 30 may be closed mechanically via a service tool to accomplish full zonal isolation. In this manner, a mechanically actuated device, e.g. valve 30, may be used in cooperation with a swellable annular sealing device, e.g. swellable packer 94.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising an apparatus having:

an outer housing coupled with an apparatus tubing and having shunt tube passages;

a plurality of shunt tubes coupled to the outer housing in communication with the shunt tube passages;

an inner sleeve mounted within the outer housing for shifting movement between an open flow position allowing flow along the shunt tube passages and a closed flow position blocking flow through the shunt tube passages and isolating upper and lower zones, the internal sleeve being mechanically shiftable via a shifting tool; and a rotationally locked scraper ring positioned about the inner sleeve.

2. The system as recited in claim 1, wherein the shunt tube passages are able to channel slurry radially inward to a pocket formed in the inner sleeve and then radially outward through exit ports.

3. The system as recited in claim 2, wherein the pocket has sloped surfaces configured to provide a flow path which reduces erosion.

4. The system as recited in claim 1, further comprising a plurality of seals mounted about the inner sleeve so as to provide two independent pressure zones when the inner sleeve is in the open flow position and three independent pressure zones when the inner sleeve is in the closed flow position.

5. The system as recited in claim 4, wherein seals of the plurality of seals are oriented to seal against an erosion tolerant seal surface.

6. The system as recited in claim 1, further comprising a plurality of redundant seals positioned about the inner sleeve and pressure balanced.

7. The system as recited in claim 6, wherein the inner sleeve comprises proppant catching slots behind seals of the plurality of redundant seals.

8. The system as recited in claim 1, wherein the shunt tube passages are arranged in an optimized flow path to minimize pressure drops and erosion.

9. The system as recited in claim 1, further comprising a packer module coupled with the apparatus.

10. The system as recited in claim 9, wherein the packer module comprises a swellable element.

11. A system for use in a well, the system comprising an apparatus having:

an outer housing coupled with an apparatus tubing and having shunt tube passages;

a plurality of shunt tubes coupled to the outer housing in communication with the shunt tube passages;

an inner sleeve mounted within the outer housing for shifting movement between an open flow position allowing flow along the shunt tube passages and a closed flow position blocking flow through the shunt tube passages and isolating upper and lower zones, the internal sleeve being mechanically shiftable via a shifting tool; and a plurality of redundant seals positioned about the inner sleeve and pressure balanced.

* * * * *